US009915886B2

(12) United States Patent
Fujita et al.

(10) Patent No.: US 9,915,886 B2
(45) Date of Patent: Mar. 13, 2018

(54) IMAGE FORMING APPARATUS, ELECTROSTATIC CHARGE IMAGE DEVELOPER, AND ELECTROSTATIC CHARGE IMAGE DEVELOPING TONER

(71) Applicant: FUJI XEROX CO., LTD., Tokyo (JP)

(72) Inventors: Asafumi Fujita, Kanagawa (JP); Shinichi Yaoi, Kanagawa (JP); Seijiro Ishimaru, Kanagawa (JP); Yasushige Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/220,769

(22) Filed: Jul. 27, 2016

(65) Prior Publication Data

US 2017/0277052 A1 Sep. 28, 2017

(30) Foreign Application Priority Data

Mar. 25, 2016 (JP) ..... 2016-061668

(51) Int. Cl.
*G03G 9/097* (2006.01)
*G03G 9/087* (2006.01)
*G03G 15/08* (2006.01)

(52) U.S. Cl.
CPC ..... *G03G 9/08755* (2013.01); *G03G 15/08* (2013.01)

(58) Field of Classification Search
CPC ..... G03G 9/08755; G03G 9/09716
See application file for complete search history.

(56) References Cited

U.S. PATENT DOCUMENTS 7,335,453 B2 * 2/2008 Sacripante ..... G03G 9/0821 430/108.4
2006/0063086 A1 * 3/2006 Sacripante ..... G03G 9/0804 430/109.4
2013/0071781 A1 * 3/2013 Saito ..... G03G 9/0812 430/105
2013/0171556 A1 * 7/2013 Fujikawa ..... G03G 9/081 430/109.4
2013/0288173 A1 * 10/2013 Hashimoto ..... G03G 9/08755 430/109.3
2014/0106275 A1 * 4/2014 Seitoku ..... G03G 9/1135 430/109.4
2016/0011531 A1 * 1/2016 Yamasaki ..... G03G 9/08755 430/105

FOREIGN PATENT DOCUMENTS

JP 2010-139937 A 6/2010
JP 2014-178528 A 9/2014

* cited by examiner

*Primary Examiner* — Hoa V Le
(74) *Attorney, Agent, or Firm* — Oliff PLC

(57) ABSTRACT

An image forming apparatus includes a developing unit that contains an electrostatic charge image developer which contains a carrier and an electrostatic charge image developing toner, wherein the toner includes toner particles which contain a polyester resin, which is a polycondensate of a polycarboxylic acid and a polyol, and has a glass transition temperature of 50° C. to 70° C., the polyol includes a polyol not having a bisphenol A structure in a range of 50% by weight to 100% by weight, and a melt viscosity A of the toner at 110° C. after storage for 2 hours under the environment of absolute humidity of 82.7 ($g/m^3$) and a melt viscosity B of the toner at 110° C. after storage for 2 hours under the environment of absolute humidity of 16.5 ($g/m^3$) each are in the ranges specified in the specification.

5 Claims, 1 Drawing Sheet

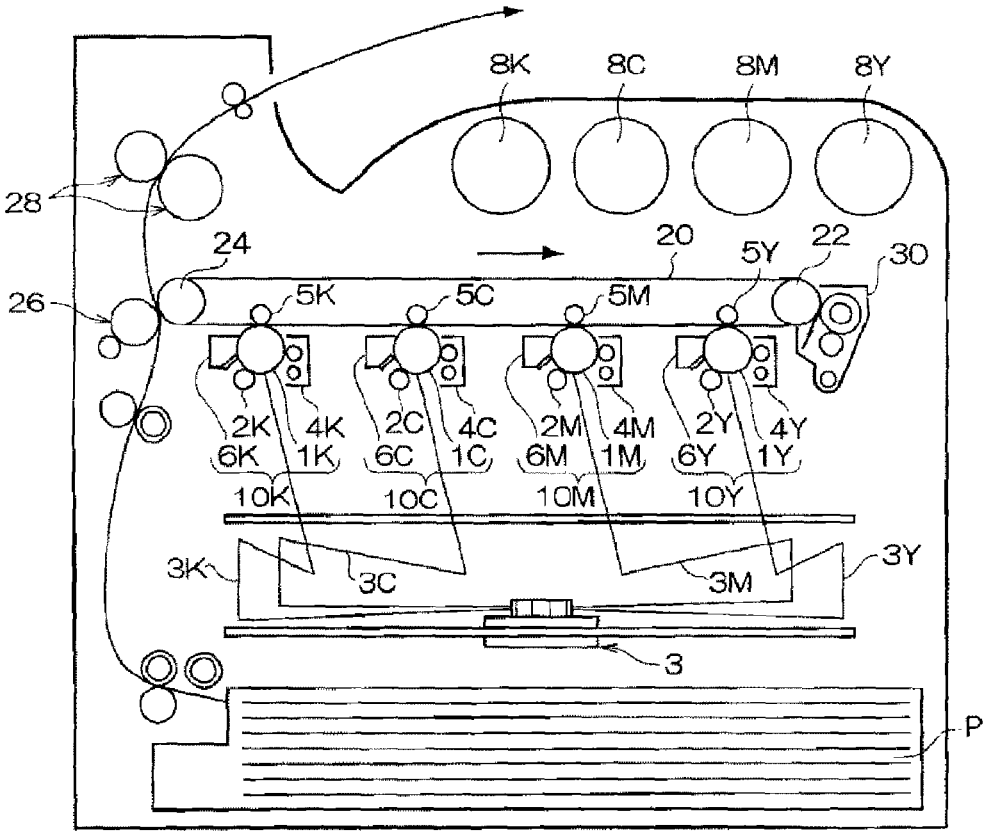
8K
8C
8M
8Y
28
24
20
5Y
22
30
26
5K
5C
5M
2K
4K
2C
4C
2M
4M
2Y
4Y
6K
1K
6C
1C
6M
1M
6Y
1Y
10K
10C
10M
10Y
3K
3C
3M
3Y
3
P

IMAGE FORMING APPARATUS, ELECTROSTATIC CHARGE IMAGE DEVELOPER, AND ELECTROSTATIC CHARGE IMAGE DEVELOPING TONER

CROSS-REFERENCE TO RELATED APPLICATIONS

This application is based on and claims priority under 35 USC 119 from Japanese Patent Application No. 2016-061668 filed Mar. 25, 2016.

BACKGROUND

1. Technical Field

The present invention relates to an image forming apparatus, an electrostatic charge image developer, and an electrostatic charge image developing toner.

2. Related Art

A method of visualizing image information through an electrostatic charge image obtained by using an electrophotography method and the like has been used in various technical fields. In the electrophotography method, an electrostatic charge image (electrostatic latent image) is formed on a photoreceptor (an image holding member) through charging and exposing steps, the electrostatic latent image is developed by using a developer containing a toner, and is visualized through transfer and fixing steps. Examples of the developer used in the above steps include a two-component developer which is formed of a toner and a carrier, and a one-component developer which only use any one of a magnetic toner and a non-magnetic toner. As a method of preparing the toner, a kneading and pulverizing method in which a thermoplastic resin is melt and kneaded together with a release agent such as a pigment, a charge-controlling agent, and wax, and the mixture is cooled, finely pulverized, and classified has been generally used. In the toners, an inorganic particle or an organic particle for improving fluidity and cleanability way be added to a surface of a toner particle if necessary.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that contains an electrostatic charge image developer and develops the electrostatic charge image formed on the surface of the image holding member as a toner image by using the electrostatic charge image developer;

a transfer unit that transfers the toner image formed on the surface of the image holding member onto a surface of a recording medium;

a cleaning unit that includes a cleaning blade for cleaning the surface of the image holding member; and a fixing unit that fixes the toner image transferred onto the recording medium, wherein the electrostatic charge image developer contains a carrier and an electrostatic charge image developing toner which includes toner particles which contain a polyester resin, which is a polycondensate of a polycarboxylic acid and a polyol, and the toner has a glass transition temperature of 50° C. to 70° C., the polyol includes a polyol not having a bisphenol A structure in a range of 50% by weight to 100% by weight with respect to the entire weight of the polyol, a melt viscosity A of the toner at 110° C. after storage for 2 hours under the environment of absolute humidity of 82.7 ($g/m^3$) is from $2.0\times10^3$ (Pa·s) to $6.0\times10^3$ (Pa·s), and a melt viscosity B of the toner at 110° C. after storage for 2 hours under the environment of absolute humidity of 16.5 ($g/m^3$) is from $1.0\times10^4$ (Pa·s) to $4.0\times10^4$ (Pa·s).

BRIEF DESCRIPTION OF THE DRAWINGS

Exemplary embodiments of the present invention will be described in detail based on the following figures, wherein:

FIG. 1 is a configuration diagram schematically illustrating an example of an image forming apparatus which is preferably used in this exemplary embodiment.

DETAILED DESCRIPTION

Hereinafter, the exemplary embodiments will be described.

Note that, in the exemplary embodiment, the description of "A to B" indicates, unless specifically noted, "a range of A to B", and the numerical range including A and B which axe both ends of the range.

1. Electrostatic Charge Image Developing Toner

The electrostatic charge image developing toner (also, simply referred to as a "toner") according to the exemplary embodiment has toner particles containing a polyester resin which is a polycondensate of polycarboxylic acid and polyol, in which the polyol which does not have a bisphenol A structure is in a range of 50% by weight to 100% by weight with respect to the entire weight of the polyol, a melt viscosity A of the toner at 110° C. after storage for 2 hours under the environment of absolute humidity of 82.7 ($g/m^3$) is from $2.0\times10^3$ (Pa·s) to $6.0\times10^3$ (Pa·s), a melt viscosity B of the toner at 110° C. after storage for 2 hours under the environment of absolute humidity of 16.5 ($g/m^3$) is from $1.0\times10^4$ (Pa·s) to $4.0\times10^4$ (Pa·s), and a glass transition temperature of the toner is from 50° C. to 70° C.

As a result of the intensive studies of the present inventors, it is found that a polyester resin having a specific structure is used as a toner, the glass transition temperature of the toner is set to be in a specific range, water absorbency of the toner is increased, and thereby the melt viscosity of the toner is reversibly changed depending on the existence of water absorption. Also it is found that the toner is excellent in anti-image fogging properties and anti-offset properties after storage under the environment of high-humidity.

In addition, it is found that when 1% by weight to 10% by weight of inorganic particles having a polyester resin on the surface thereof are externally added to the toner with respect to the entire weight of the toner, the variation of the melt viscosity of the toner may be more easily adjusted depending on the existence of water absorption, and the anti-image fogging properties and the anti-offset properties after storage under the environment of high-humidity further become excellent.

Melt Viscosity of Toner

As for the electrostatic charge image developing toner according to the exemplary embodiment, the melt viscosity A of the toner at 110° C. after storage for 2 hours under the environment of absolute humidity of 82.7 ($g/m^3$) is from $2.0\times10^3$ (Pa·s) to $6.0\times10^3$ (Pa·s), and the melt viscosity B of the toner at 110° C. after storage for 2 hours under the environment of absolute humidity of 16.5 ($g/m^3$) is from $1.0\times10^4$ (Pa·s) to $4.0\times10^4$ (Pa·s).

A method of measuring the melt viscosity of the toner is performed by obtaining the viscosity at a temperature corresponding to the midpoint (½) between the flow-starting temperature and the flow-completion temperature in the measurement in which a 1 $cm^3$ sample is melted and allowed to flow out in an elevated flow tester CFT-500 (manufactured by Shimadzu Corporation) with a dice pore diameter of 0.5 mm at a load pressure of 0.98 KPa (10 $kg/cm^2$) and a temperature increase rate of 1° C./min.

In addition, the temperature at the time of storing for 2 hours under the environment of the absolute humidity of 82.7 ($g/m^3$) or 16.5 ($g/m^3$) is not particularly limited as long as the absolute humidity is the above value, and is preferably from 45° C. to 50° C. (45° C. to 50° C. with 100% RH or 45° C. to 50° C. with 20% RH).

The melt viscosity A of the toner at 110° C. after storage for 2 hours under the environment of absolute humidity of 82.7 ($g/m^3$) is preferably from $3.0\times10^3$ (Pa·s) to $6.0\times10^3$ (Pa·s), is further preferably from $3.2\times10^3$ (Pa·s) to $5.0\times10^3$ (Pa·s), and is particularly preferably from $3.5\times10^3$ (Pa·s) to $4.5\times10^3$ (Pa·s). When the melt viscosity A is in the above-described range, the anti-offset properties and the anti-image fogging properties become excellent.

In addition, the melt viscosity B of the toner at 110° C. after storage for 2 hours under the environment of absolute humidity of 16.5 ($g/m^3$) is preferably from $1.5\times10^4$ (Pa·s) to $3.5\times10^4$ (Pa·s), is further preferably from $1.6\times10^4$ (Pa·s) to $3.0\times10^4$ (Pa·s), and is particularly preferably from $1.7\times10^4$ (Pa·s) to $2.5\times10^4$ (Pa·s). When the melt viscosity B is in the above-described range, the anti-offset properties and the anti-image fogging properties become excellent.

Glass Transition Temperature of Toner

The glass transition temperature of the electrostatic charge image developing toner according to the exemplary embodiment is from 50° C. to 70° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics". The measurement is performed by heating 10 mg of sample at a constant increasing temperature rate (10° C./min) by using a differential thermal analyzer DSC-20 (manufactured by Seiko Instruments Inc.).

In addition, the gloss transition temperature of the electrostatic charge image developing toner according to the exemplary embodiment is preferably from 52° C. to 65° C., and is further preferably from 55° C. to 62° C. When the glass transition temperature is in the above-described range, the anti-offset properties become further excellent.

Polyester Resin

The electrostatic charge image developing toner according to the exemplary embodiment has toner particles containing the polyester resin which is the polycondensate of polycarboxylic acid and polyol, in which the polyol which does not have a bisphenol A structure is from 50% by weight to 100% by weight with respect to the entire weight of the polyol.

The electrostatic charge image developing toner according to the exemplary embodiment preferably contains the polyester resin as a binder resin.

The polyester resin may use a compound other than polycarboxylic acid and polyol as a raw material, and a polyester resin formed of polycarboxylic acid, polyol, and an epoxy compound is preferably used.

In addition, the polycarboxylic acid is preferably dicarboxylic acid, and the polyol is preferably diol, and is further preferably aliphatic diol.

Further, polyol which does not have the bisphenol A structure is preferably aliphatic polyol.

In the polyester resin, polyol which does not have the bisphenol A structure is 50% by weight to 100% by weight, is preferably from 70% by weight to 100% by weight, is further preferably from 80% by weight to 100% by weight, is still further preferably from 90% by weight to 100% by weight, and is particularly preferably 100% by weight with respect to the entire weight of the polyol which is a raw material. With such a configuration, anti-image fogging properties and anti-offset properties after storage under the high-humidity environment become excellent.

In a case where greater than 50% by weight of polyol having a bisphenol A structure is used, the water absorbency of a resin to be obtained is not sufficiently obtained, and thus the anti-image fogging properties and anti-offset properties after storage under environment of high-humidity become deteriorated.

The polycarboxylic acid, the polyol, and the epoxy compound may be used singly or in combination of two or more types thereof.

As the aliphatic polyol, aliphatic polyol having 2 to 8 carbon atoms is preferably used, and aliphatic polyol having 2 to 6 carbon atoms is further preferably used from the viewpoint of durability.

Examples of the aliphatic polyol include diol such as ethylene glycol, 1,2-propylene glycol, 1,3-propylene glycol, 1,4-butanediol, 1,5-pentanediol, 1,6-hexanediol, neopentyl glycol, 1, 4-butenediol, 1,7-heptane diol, and 1,8-octanediol, and trivalent or more polyol such as glycerol, pentaerytnritol, and trimethylol propane. Among them, α,ω-straight chain alkane diol is preferably used, α,ω-straight chain alkene diol having 2 to 8 carbon atoms is further preferably used, and α,ω-straight chain alkane diol having 2 to 5 carbon atoms is particularly preferably used.

In addition, ethylene glycol and 1,5-pentanediol are particularly preferably used in combination.

Polyol components other than the polyol component and the aliphatic polyol may be contained, and examples thereof include divalent aromatic alcohols such as alkylene (2 to 3 carbon atoms) oxide (average addition molar number in a range of 1 to 10) adducts of bisphenol A.

In addition, the polyester resin preferably has a monomer unit expressed by the following formula (1) as a monomer unit derived from a polyol which does not have the bisphenol A structure.

$$\text{+O—}R^{al}\text{—O+} \quad (1)$$

In the formula (1), $R^{al}$ represents an alkylene group having 2 to 8 carbon atoms.

The alkylene group in the $R^{al}$ may be a straight-chain alkylene group or a branched alkylene group.

In the formula (1), $R^{al}$ preferably represents an alkylene group having 2 to 4 carbon atoms, and further preferably represents an alkylene group having 2 or 3 carbon atoms.

Examples of the polycarboxylic acid include aromatic polycarboxylic acid such as phthalic acid, isophthalic acid, terephthalic acid, trimellitic acid, pyromelittic acid, and 5-sulfoisophthalic acid monosodium; aliphatic polycarboxylic acid such as succinic acid substituted with an alkyl group having 1 to 20 carbon atoms or an alkenyl group having 2 to 20 carbon atoms such as fumaric acid, maleic acid, adipic acid, succinic acid, dodecenyl succinic acid, and octenyl succinic acid; anhydrides thereof; and alkyl (1 to 8 carbon atoms) ester.

Among them, as the polycarboxylic acid, a dicarboxylic acid is preferably used.

The polycarboxylic acid preferably includes aromatic polycarboxylic acid, and preferably contains an aromatic dicarboxylic acid compound from the viewpoint of charging properties.

In addition, the polycarboxylic acid preferably includes polycarboxylic acid containing a sulfo group or the salt thereof such as 5-sulfoisophthalic acid monosodium.

In the polyester resin, the aromatic polycarboxylic acid is preferably from 70% by weight to 100% by weight, is further preferably from 80% by weight to 100% by weight, is still further preferably from 90% by weight to 100% by weight, and is particularly preferably 100% by weight, with respect to the entire weight of the polycarboxylic acid which is a raw material.

In addition, in the polyester resin, the total number of moles of the hydroxy group of the polyol is preferably greater than the total number of moles of the carboxyl group of the polycarboxylic acid.

The polyester resin is a polyester resin obtained by polycondensing polycarboxylic acid, polyol, and an epoxy compound.

The epoxy compound is preferably a polyvalent epoxy compound.

Examples of the epoxy compound include a polymer or copolymer of a vinyl compound having a bisphenol A type epoxy resin, a novolak type epoxy resin, ethylene glycol diglycidyl ether, glycerol triglycidyl ether, trimethylolpropane trigiycidyl ether, trimethylolethane triglycidyl ether, pentaerythritol tetraglycidyl ether, hydroquinone diglycidyl ether, a cresol novolac epoxy resin, a phenol novolak epoxy resin, a polymer or copolymer of a vinyl compound having an epoxy group; epoxidized resorcinol-acetone condensate; and partially epoxidized polybutadiene. Among them, the cresol novolac epoxy resin and the phenol novolac epoxy resin are preferably used from the viewpoint of the reactivity.

In the polyester resin, the use amount of the epoxy compound is preferably from 1 mole % to 20 mole %, is further preferably from 2 mole % to 15 mole %, and is particularly preferably from 5 mole % to 12 mole %, with respect to the entire amount of polyol.

The weight average molecular weight Mw of polyester resin is preferably from 10,000 to 200,000, is further preferably from 30,000 to 150,000, and is particularly preferably from 60,000 to 120,000.

The weight average molecular weight of the resin in the exemplary embodiment is measured by using a tetrahydrofuran (THP) soluble portion through a gel permeation chromatography (SPC) method. The molecular weight of the resin is calculated using a molecular weight calibration curve plotted from a manodisperse polystyrene standard sample obtained by measuring a THF soluble material with a THF solvent by using TSK-GEL (GMH (manufactured by Tosoh Corporation)).

The polyester resin may be used singly or in combination of two or more types thereof.

The content of the polyester resin in the electrostatic charge image developing toner according to the exemplary embodiment is preferably from 50% by weight to 99% by weight, is further preferably from 60% by weight to 97% by weight, and is particularly preferably from 70% by weight to 95% by weight with respect to the entire toner amount.

Release Agent

The electrostatic charge image developing toner according to the exemplary embodiment preferably contains the release agent.

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

Among them, as the release agent, the hydrocarbon waxes (waxes having a hydrocarbon as a skeleton) are preferably used, and polyethylene waxes are further preferably used. The hydrocarbon waxes easily form a release agent domain and rapidly stain on the toner (toner particles) surface at the time of fixation, and thus preferably used.

The release agent may be used singly or in combination of two or mere types thereof.

The content of the release agent in the toner is preferably from 1.0% by weight to 20% by weight, and is further preferably 5.0% by weight to 15% by weight.

Colorant

The electrostatic charge image developing toner according to the exemplary embodiment preferably contains the colorant.

The colorant may be or may be not a pigment, but the pigment is used from the viewpoint of light resistance and waterproof properties. In addition, the colorant is not limited to a colored colorant, but includes a white colorant or a colorant having metal color.

Examples of the colorant include well-known pigments such as carbon black, aniline black, aniline blue, calco oil blue, chrome yellow, ultramarine blue, Dupont oil red, quinoline yellow, methylene blue chloride, phthalocyanine blue, malachite green oxalate, lamp black, rose bengal, quinacridone, benzidine yellow, C.I. Pigment•Red 48:1, C.I. Pigment•Red 57:1, C.I. Pigment•Red 122, C.I. Pigment•Red 185, C.I. Pigment•Red 238, C.I. Pigment•Yellow 12, C.I. Pigment•Yellow 17, C.I. Pigment•Yellow 180, C.I. Pigment•Yellow 97, C.I. Pigment•Yellow 74, C.I. Pigment•Blue 15:1, and C.I. Pigment•Blue 15:3.

The content of the colorant in the electrostatic charge image developing toner according to the exemplary embodiment is preferably from 1 part by weight to 30 parts by weight with respect to 100 parts by weight of the binder resin In addition, a colorant which is subjected to a surface treatment, or a pigment dispersant is efficiently used. In accordance with the types of the colorants, a yellow toner, a magenta toner, a cyan toner, black toner, and the like are prepared.

Other Binder Resins

The electrostatic charge image developing toner according to the exemplary embodiment may contain a binder resin (other binder resins) other than the polyester resin; however, other binder resins are preferably not contained.

In a case of containing the binder resin other than the polyester resin, the content thereof is less than the content of the polyester resin, is preferably equal to or less than 10% by weight, is further preferably equal to or less than 5% by weight, and is particularly preferably 0% by weight, with respect to the entire weight of the toner.

Other binder resins are not particularly limited, and examples thereof include a homopolymer prepared by monomers such a styrenes such as styrene, para-chlorostyrene, and α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrlle and methacrylonitrile; vinyl ethers such as vinyl methyl ether and vinyl isobutyl ether; vinyl ketones such as vinyl methyl ketone, vinyl ethyl ketone, and vinyl isopropenyl ketone; and polyolefins such as ethylene, propylene, and butadiene, a copolymer obtained by combining two or more types of the monomers, and a mixture thereof. In addition, Examples thereof further include non-vinyl condensation resins such as an epoxy resin, a polyester resin, a polyurethane resin, a polyamide resin, a cellulose resin, and a polyether resin, mixtures of these with the vinyl resins, and graft polymers obtained by polymerizing the vinyl monomers in the copresence thereof.

The styrene resin, the (meth)acrylic resin, and the styrene-(meth)acryl copolymer resin may be obtained, for example, by applying a known method to styrene monomers and (meth)acrylate monomers alone or in combination. Here, the "(meth)acryl" includes any of "acryl" and "methacryl".

When the styrene resin, the (meth) acrylic resin, and the copolymer resin thereof are used as the binder resin, the weight-average molecular weight Mw is preferably in the range of 20,000 to 100,000, and the number average molecular weight Mn is preferably in the range of 2,000 to 30,000.

Other Additives

The electrostatic charge image developing toner according to the exemplary embodiment may further include, as necessary, various other additives, such as an internal additive and a charge-controlling agent, other than the above-described components.

Examples of the internal additive include metal such as ferrite, magnetite, reduced iron, cobalt, nickel, and manganese, alloys, or magnetic materials such as compounds containing these metals.

Examples of the charge-controlling agent include a quaternary ammonium salt compound, a nigrosine compound, a dye including a complex with aluminum, iron, or chromium, and a triphenylmethane pigment.

Method of Preparing Toner Particles

The method of preparing the toner particles is not particularly limited, and examples thereof generally include a suspension polymerization method, a dissolution suspension method, an emulsion polymerization method and a kneading and pulverizing method.

Pertaining to the kneading and pulverizing method, the particle size distribution is easily expanded, and fine powders are easily increased with the large volume average particle diameter.

Pertaining to the emulsion polymerization method, it is easy to make the toner particles small with the small particle wire distribution, and the smoothness of the toner surface and the sphericity control may be realized.

In a case where the kneading and pulverizing method is used, the toner particles are prepared as follows. For example, a binder resin, a release agent, a charge-controlling agent, and a colorant are sufficiently mixed with each other by using a mixer such as a HENSCHEL mixer and a ball mill, the mixture is molten-kneaded by using a heat kneading machine such as a heating roller, a kneader, and an extruder, the release agent, the charge-controlling agent, and the colorant are dispersed or dissolved in a solution in which the binder resin is compatibilized, and then the resultant is coaled and solidified, mechanically pulverized in a predetermined particle size, and classified, thereby adjusting the particle size distribution. Alternatively, the fine pulverized materials which are obtained by colliding with the target under the jet stream after cooling and solidifying steps ore subjected to spheronisation by thermal or mechanical impact force so as to obtain the toner particles.

In the pulverizing method, a pulverizer equipped with a crushing plate (IDS-2, manufactured by Nippon Pneumatic Mfg. Co., Ltd.) is preferably used to perform pulverization, and an ELBOW-JET AIR CLASSIFIER (manufactured by MATSUBO Corporation) is preferably used to perform classification. In the pulverizing step, the particle size of the toner particle becomes small and line when a pulverizing pressure is increased or the treatment amount is reduced, and thus it is easy to adjust the particle size of the toner particle. In the subsequent classifying step, it is easy to adjust an amount of fine powders by changing a position of a classifying edge.

External Additive

The electrostatic charge image developing toner according to the exemplary embodiment preferably contains an external additive.

The external additive preferably contains inorganic particles having a polyester resin on the surface thereof. With such a configuration, the anti-offset properties at a low temperature after storage under the high-humidity environment become excellent.

As the polyester resin in the Inorganic particles having the polyester resin, the polyester resin in the toner particles is used, and preferably has the same configuration.

The inorganic particles in the inorganic particles having the polyester resin on the surface thereof is not particularly limited, and well-known inorganic particles as the external additive of the toner are used. Examples thereof include inorganic particles such as silica, alumina, titanium oxide (titanium oxide, metatitanic acid, and the like), cerium oxide, zirconia, calcium carbonate, magnesium carbonate, calcium phosphate, and carbon black. Among them, silica particles are particularly preferably used.

In addition, the inorganic particles having the polyester resin on the surface thereof are preferably inorganic particles having a coating layer containing the polyester resin on the surface thereof, and are further preferably inorganic particles a coating layer formed of the polyester resin on the surface thereof.

The average primary particle diameter of the inorganic particles having the polyester resin on the surface thereof is preferably from 10 nm to 500 nm, is further preferably from 10 nm to 300 nm, is still further preferably from 10 nm to 200 nm, and is particularly preferably from 20 nm to 80 nm.

The content of the polyester resin in the inorganic particles having the polyester resin on the surface thereof is preferably from 0.1 parts by weight to 10 parts by weight, is further preferably from 0.2 parts by weight to 8 parts by weight, and is particularly preferably from 0.5 parts by weight to 5 parts by weight, with respect to 100 parts by weight of inorganic particles.

The content of the inorganic particles having the polyester resin on the surface thereof in the electrostatic charge image developing toner according to the exemplary embodiment is preferably from 0.5% by weight to 10% by weight, and is further preferably from 1% by weight to 10% by weight, with respect to the entire weight of the toner. When the content is in the above-described range, the anti-image fogging properties, and the anti-offset properties after the storage under the high-humidity environment become excellent.

In addition, as the external additive, a polymer having a carboxyl group is preferably used. With such a configuration, the anti-offset properties at a low temperature after storage under the high-humidity environment become excellent.

The polymer having a carboxyl group is not particularly limited, and examples thereof include a homopolymer prepared by a monomer such a styrenes such as styrene, para-chloro-styrene, and α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and polyolefins such as ethylene, propylene, and butadiene, a copolymer obtained by combining two or more types of monomers, and a mixture thereof. In addition, Examples thereof further include non-vinyl condensation resins such as an epoxy resin, a polyester resin, a polyurethane resin, a polyamide resin, a cellulose resin, and a polyether resin, mixtures of these with the vinyl resins, and graft polymers obtained by polymerizing the vinyl monomers in the copresence thereof.

Among them, a styrene-acrylic resin having a carboxyl group is preferably used.

A method of introducing the carboxyl group to the polymer is not particularly limited, and examples thereof include well-known methods. Among them, a method of copolymerizing unsaturated carboxylic acid such as acrylic acid and methacrylic acid is preferably used.

The amount of a monomer unit having a carboxyl group in the polymer having a carboxyl group is preferably from 0.1% by weight to 10% by weight, and is further preferably from 0.5% by weight to 5% by weight with respect to the entire weight of the polymer.

The weight average molecular weight of the polymer having a carboxyl group is preferably from 10,000 to 100,000, is further preferably from 20,000 to 80,000, and is particularly preferably from 30,000 to 60,000.

In addition, the polymer having a carboxyl group preferably has a nitrogen atom, and further preferably has a nitrogen atom and a sulfur atom.

As the nitrogen atom, a dialkylamino group is preferably used.

As the sulfur atom, an alkylthio group is preferably used.

A method of introducing the nitrogen atom to the polymer is not particularly limited, and examples thereof include well-known methods. Among them, a method of copolymerizing a monomer having an amino group such as dialkylamino ethyl (meth)acrylate is preferably used.

A method of introducing the sulfur atom to the polymer is not particularly limited, and examples thereof well-known methods. Among them, a method of adding a thiol compound as a chain transfer agent at the time of performing the copolymerization is preferably used.

The amount of the monomer unit having a nitrogen atom in the polymer having a carboxyl group is preferably from 10% by weight to 80% by weight, is further preferably from 20% by weight to 75% by weight, and is particularly preferably from 40% by weight to 70% by weight, with respect to the entire weight of the polymer.

The content of the polymer having a carboxyl group in the electrostatic charge image developing toner according to the exemplary embodiment is preferably from 0.02% by weight to 10% by weight, is further preferably from 0.05% weight to 5% by weight, and is particularly preferably from 0.1% by weight to 2% by weight, with respect to the entire weight of the toner. When the content is in the above-described range, the anti-image fogging properties and the anti-offset properties after high-humidity environment storage become more excellent.

In addition, as the external additive, inorganic particles (other inorganic particles) are preferably used other than the inorganic particles having a polyester resin on the surface thereof.

Examples of other inorganic particles include silica, alumina, titanium oxide (titanium oxide, metatitanic acid and the like), cerium oxide, zirconia, calcium carbonate, magnesium carbonate, calcium phosphate, and carbon black. Among them, the silica particles are particularly preferably used.

Examples of the silica particles include silica particles such as fumed silica, colloidal silica, and silica gel, which are used without any particular limitation.

In addition, the external additive may be subjected to a hydrophobic treatment by using a silane coupling agent which will be described below.

The hydrophobic treatment may be performed by dipping the inorganic particles into a hydrophobizing agent. The hydrophobizing agent is not particularly limited, and examples thereof include a silane coupling agent, a titanate coupling agent, and an aluminum coupling agent. These may be used singly or in combination of two or more types thereof. Among them, the silane coupling agent is preferably used.

Examples of the silane coupling agent include any type of chlorosilane, alkoxysilane, silazane, and a special silylation agent.

Specifically, examples of the silane coupling agent include methyl trichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl triethoxysilane, decyl trimethoxysilane, hexamethyl disilazane, N,O-(bistrimethyl silyl) acetamide, N,N-(trimethyl silyl)urea, tert-butyl dimethyl chlorosilane, vinyl trichlorosilane, vinyl trimethoxysilane, vinyl triethoxysilane, γ-methacryloxypropyl trimethoxysilane, β-(3,4-epoxycyclohexyl) ethyl trimethoxy silane, γ-glycidoxypropyl trimethoxysilane, γ-glycidoxypropyl methyldiethoxysilone, γ-mercaptopropyl trimethoxysilane, and γ-chloropropyl trimethoxysilane.

The amount of the hydrophobizing agent is different depending on the types of the particles, and thus cannot be unconditionally defined; however, the amount thereof is preferably from 1 parts by weight to 50 parts by weight, and is further preferably from 5 parts by weight to 20 parts by weight, with respect to 100 parts by weight of particles. Note that, in the exemplary embodiment, as the hydrophobic silica particles which are subjected to the hydrophobic treatment, commercially available products are preferably used.

The average primary particle diameter of other inorganic particles is preferably from 1 nm to 500 nm, is further preferably from 5 nm to 300 nm, is still further preferably from 10 nm to 200 nm, and is particularly preferably from 10 nm to 50 nm.

The additive amount of other inorganic particles is preferably from 0.1 parts by weight to 5 parts by weight, and is further preferably from 0.3 parts by weight to 2 parts by weight, with respect to 100 parts by weight of the toner. When the additive amount is equal to or greater than 0.1 parts by weight, the fluidity of the toner is properly set, and charging properties and charge exchanging properties become excellent. On the other hand, when the additive amount is equal to or less than 5 parts by weight, a coated state Is properly set, and the external additive may be prevented from being transitioned to a contact member, and thus the occurrence of secondary failure is prevented.

Method of Externally Adding External Additive

The method of externally adding the external additive in the electrostatic charge image developing toner according to the exemplary embodiment is not particularly limited, and well-known external addition methods are used. For example, the toner particles and various types of external additives are mixed with each other by using a HENSCHEL mixer, and then coarse powders are removed by using a sieve (a screening classifier), thereby obtaining a toner.

Properties of Toner

The volume average particle diameter of the electrostatic charge image developing toner according to the exemplary embodiment is preferably from 2 μm to 20 μm, and is further preferably from 5 μm to 14 μm. When the volume average particle diameter is in the above-described range, the anti-image fogging properties become further excellent.

Note that, the volume average particle diameter of the toner is preferably measured by using COULTER MULTISIZER II (manufactured by Beckroan Coulter, Inc.), and electrolyte is preferably measured by using ISOTON-II (manufactured by Beckman Coulter, Inc.).

Specific examples of the measuring method include the following method.

1.0 mg of a measurement sample is added to 2 ml of a 5% by weight aqueous solution of, as a dispersant, a surfactant, preferably sodium alkylbenzene sulfonate. The mixture is added to 100 mL of the electrolyte such that the measurement sample is suspended therein. The electrolyte in which the sample is suspended is subjected to a dispersion treatment using an ultrasonic disperser for one minute, and a particle size distribution and a number average distribution of particles having a particle size of from 1 μm to 30 μm is measured by a COULTER MULTISIZER II using an aperture having an aperture diameter of 50 μm. 50,000 particles are sampled.

Further, the particle size distribution of the electrostatic charge image developing toner according to the exemplary embodiment is preferably in a narrow range, and more specifically, the ratio of 16% diameter ($D_{16v}$) to 84% diameter ($D_{84v}$)) is shown as a square root (GSDv) in terms of smaller volume particle size of the toner, that is, GSDv expressed by the following Expression is preferably equal to or less than 1.21, is further preferably equal to or less than 1.19, and is particularly preferably equal to or less than 1.17.

$$GSDv=\{(D_{84v})/(D_{16v})\}^{0.5} \quad (1)$$

(In Expression (1), $D_{84v}$ and $D_{16v}$ particle size at the accumulation of 84% and 16% when a volume cumulative distribution curve is drawn from the small diameter side with respect to the particle size range divided.)

When the GSDv is in the above-described range, the formation of particles having an excessively large toner charge amount is prevented, and thus the deterioration of the reproducibility of multi-order color fine lines is prevented.

Moreover, as for the electrostatic charge image developing toner according to the exemplary embodiment, the shape factor SF1 is preferably from 110 to 140, and is further preferably from 110 to 130. When the shape thereof is spherical in the above range, the transfer efficiency and compactness of the image are improved, thereby forming a high-quality image.

Here, the above-described shape factor SF1 is calculated by using the following Expression (E).

$$SF1=(ML^2/A)\times(\pi/4)\times 100 \quad \text{Expression (E)}$$

(In the Expression (E), ML represents the absolute maximum length of the toner and A represents the projected area of the toner.)

The SF1 value may be obtained by analyzing an image captured by a microscope or a scanning electron microscope (SEM) by (neons of an image analyzer and calculated as a numerical value, for examples, as described below. That is, the SF1 value may be obtained by inputting an optical microscopic image of particles sprayed on the surface of a slide glass via a video camera into a LUZEX image analyzer, determining the maximum length and the projected area of 100 particles, calculating the values by the Expression (E) above, and then averaging the values.

2. Electrostatic Charge Image Developer

The electrostatic charge image developing toner according to the exemplary embodiment is preferably used as an electrostatic charge image developer.

The electrostatic charge image developer according to the exemplary embodiment is not particularly limited as long as it contains the electrostatic charge image developing toner according to the exemplary embodiment, and may employ a proper component composition in accordance with the purpose. When being used alone, the electrostatic charge image developing toner according to the exemplary embodiment is prepared as an one-component electrostatic charge image developer, and when being used in combination with the carrier, the electrostatic charge image developing toner according to the exemplary embodiment is prepared as a two-component electrostatic charge image developer.

The one-component developer is applied to a method of developing an electrostatic latent image with a charge toner obtained by fractionally charging a developing sleeve or a charging member.

In the exemplary embodiment, the developing method is not particularly limited, and the two-component developing type is preferably used, and the electrostatic charge image developer according to the exemplary embodiment preferably contains the carrier.

The carrier is not particularly limited, and examples of cores of the carrier include magnetic metals such as iron, steel, nickel, and cobalt; an alloy of these magnetic metals, manganese, chromium, and a rare earth; and magnetic oxide such as ferrite and magnetite. From the viewpoint of core surface properties and core resistance, ferrite, and particularly, an alloy of manganese, lithium, strontium, magnesium or the like are preferably used.

The carrier used in the exemplary embodiment is preferably a carrier in which the surface of the core is coated with a resin. The resin is not particularly limited, and properly selected in accordance with the purpose. In addition, at the time of coating the surface of the core with the resin, resin particles and/or conductive particles are preferably dispersed in the resin. Examples of the resin particles include thermoplastic resin particles and thermosetting resin particles.

A method of forming the resin is not particularly limited, and examples thereof include a method of using a coating liquid for forming coating which contains the resin particles such as crosslinked resin particles and/or conductive particles, and the resin such as a matrix resin such as a styrene-acrylic resin, a fluorine resin, and a silicone resin, in a solvent.

Specific examples of the method include a dipping method in which the cores of carrier are dipped in a solution for forming a coating resin layer, a spray method in which a solution for forming a coating layer is sprayed on the surface of the cores of carrier, and a kneader coater method in which the cores of carrier are mixed with a solution for forming a coating resin layer while the cores of carrier are floated by fluidizing air, and the solvent is removed. Among them, the kneader coater method is preferably used in the exemplary embodiment.

The average particle diameter of the carrier and the core particles is preferably from 10 μm to 100 μm, and is further preferably from 20 μm to 80 μm.

The mixing ratio of the toner to the carrier in the electrostatic charge image developer according to the exemplary embodiment is preferably from 1 parts by weight to 30 parts by weight of the toner, and is further preferably from 3 parts by weight to 20 parts by weight of the toner with respect to 100 parts by weight of the carrier. In addition, a method of preparing the electrostatic charge image developer is not particularly limited, and examples thereof include a method of mixing by using a V-blender.

3. Image Forming Method

The electrostatic charge image developing toner according to the exemplary embodiment is used in an electrostatic charge image developing type (electrophotographic) image forming method.

The image forming method according to the exemplary embodiment may be an image forming method using the electrostatic charge image developing toner according to the exemplary embodiment, and is preferably a method which includes a step of forming an electrostatic latent image on a surface of an image holding member, a step of developing the electrostatic latent image formed on the surface of the image holding member by using a developer containing the toner so as to form a toner image, a step of transferring the toner image onto a surface of a transfer medium, and a step of fixing the toner image transferred onto the surface of the transfer medium, in which the electrostatic charge image developing toner according to the exemplary embodiment is used as the toner, or the electrostatic charge image developer according to the exemplary embodiment is used as the developer.

In addition, the image forming method according to the exemplary embodiment further includes a step of cleaning the developer remaining on the image holding member by using a cleaning blade or the like.

The respective steps are typical steps. Note that, the image forming method according to the exemplary embodiment may be performed by using a known image forming apparatus such as a copying machine and a facsimile machine.

The electrostatic latent image forming step is a step of forming the electrostatic latent image on the surface of the image holding member (a photoreceptor).

The developing step is a step of developing the electrostatic charge image by using an image developer layer on a developer holding member so as to form the toner image.

The transfer step is a step of transferring the toner image on the transfer medium. In addition, examples of the transfer medium in the transfer step include an intermediate transfer member or a recording medium such as a sheet.

In the fixing step, a method of fixing the toner image transferred onto a transfer sheet by using a heat-roller fixing device of which the temperature of the heat roller is set to be a certain temperature so as to form a transfer image is exemplified.

The cleaning step is a step of removing the electrostatic charge image developer remaining on the image holding member by using the cleaning blade.

Examples of the material for the cleaning blade preferably include methane rubber, neoprene rubber, and silicone rubber.

Examples of the recording medium include well-known matters such as paper used for an electrophotographic copying machine, a printer, or the like, and an OHP sheet, and, for example, coated paper obtained by coating a surface of plain paper with a resin or the like, or art paper for printing is preferably used.

The image forming method according to the exemplary embodiment may further include a recycle step. The recycle step is a step of transferring collected electrostatic charge image developing toners from the cleaning step to a developer layer. The image forming method including the recycle step is performed by using an image forming apparatus such as a toner recycling system type of copy machine and a facsimile machine. In addition, the method may be applied to a recycle system in which the toner is concurrently developed and collected, instead of the cleaning step.

4. Image Forming Apparatus

The image forming apparatus according to the exemplary embodiment may include a developing unit that develops an electrostatic latent Image by using electrostatic charge image developer according to the exemplary embodiment, and is preferably an apparatus which is provided with an image holding member, a charging unit that charges the image holding member, an exposure unit that forms an electrostatic latent image on the surface of the image holding member by exposing the charged image holding member, a developing unit that develops the electrostatic latent image by using a developer containing the toner so as to forma toner image, a transfer unit that transfers the toner image to a surface of a transfer medium from the image holding member, and a fixing unit that fixes the toner image transferred onto the transfer medium, in which the toner is the electrostatic charge image developing toner according to the exemplary embodiment, or the developer is the electrostatic charge image developer according to the exemplary embodiment.

In addition, the image forming apparatus according to the exemplary embodiment preferably includes a cleaning unit for cleaning the image holding member by using a cleaning blade or the like.

FIG. 1 is a configuration diagram schematically illustrating a four tandem type color image forming apparatus. The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roller 22 and a support roller 24 contacting the inner surface of the intermediate transfer belt 20, which are separated from each other on the left and right sides in the drawing, and travels in a direction toward the fourth unit 10K from the first unit 10Y. The support roller 24 is pressurized in a direction in which it departs from the driving roller 22 by a spring or the like (not shown), and a tension is given to the intermediate transfer belt 20 wound on both of the rolls. In addition, an intermediate transfer member cleaning device 30 opposed to the driving roller 22 is provided on a surface of the intermediate Transfer belt 20 on the image holding member side. Developing devices (developing units) 4Y, 4M, 4C, and 4K of the units 10Y, 10M, 10C, and 10K are supplied with toners including four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration. Thus, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member (a photoreceptor). Around the photoreceptor 1Y, a charging roller (a charging device or a charging unit) 2Y that charges a surface of the photoreceptor 1Y to a predetermined potential, an exposure device (an exposure unit) 3 that exposes the charged surface with laser beams 3Y based on a color-separated image signal to form an electrostatic charge image, a developing device (a developing unit) 4Y that supplies a charged toner to the electrostatic charge image to develop the electrostatic charge image, a primary transfer roller (a primary transfer unit) 5Y that transfers the developed toner image onto the intermediate transfer belt 20, and a photoreceptor cleaning device (a cleaning unit) 6Y that removes the toner remaining on the surface of the photoreceptor 1Y after primary transfer, are arranged in sequence.

The primary transfer roller 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roller under the control of a controller (not shown).

Hereinafter, an operation of forming a yellow image in the first unit 10Y will be described. First, before the operation, the surface of the photoreceptor 1Y is charged by the charging roller 2Y. The laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, so that an electrostatic charge image of a yellow image pattern is formed on the surface of the photoreceptor 1Y. In this way, the electrostatic charge image formed on the photoreceptor 1Y is rotated up to a predetermined developing position with the travelling of the photoreceptor 1Y. The electrostatic charge image on the photoreceptor 1Y is visualized (developed, toner-imaged) at the developing position by the developing device 4Y.

The developing device 4Y contains, for example, an electrostatic charge image developer including at least a yellow toner and a carrier. By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner Image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, so that the toner image on the photoreceptor 1Y is transferred onto the intermediate transfer belt 20. On the other hand, the toner remaining on the photoreceptor 1Y is removed and collected by the cleaning unit 6Y including the cleaning blade.

Further, the primary transfer biases that are applied to the primary transfer rolls 5M, 5C, and 5K of the second unit 10M and the subsequent units are also controlled in the same manner as in the case of the first unit. In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (a secondary transfer unit) 26 disposed on the image holding surface side of the intermediate transfer belt 20. Meanwhile, a recording sheet (a recording medium) P is supplied to a gap between the secondary transfer roller 26 and the intermediate transfer belt 20, that are brought into contact with each other, via a supply mechanism at a predetermined timing, and a secondary transfer bias is applied to the support roller 24, thereby transferring the toner image on the intermediate transfer belt 20 onto the recording sheet P.

Thereafter, the recording sheet P is fed to a pressure-contacting part (a nip part) between a pair of fixing rolls in a fixing device (a roll-shape fixing unit) 28 so as to heat the toner images and thus the color-layered toner image is melted and fixed onto the recording sheet P. The recording sheet P on which the fixing of the color image is completed is discharged toward a discharge part, and a series of the color image forming operations are finished.

Note that, the image forming apparatus according to the exemplary embodiment is not particularly limited as long as it includes at least the image holding member, the charging unit, the exposure unit, the developing unit, the transfer unit, and the cleaning unit which are described above. Also, the image forming apparatus may include a fixing unit, an erasing unit, and the like if necessary.

In the transfer unit, the transfer may be performed twice by using the intermediate transfer medium. In addition, examples of the transfer medium in the transfer unit include a recording medium such as an intermediate transfer medium and a sheet.

The image holding member, and the respective units described above may preferably employ the configurations described in the respective steps of the image forming method. As the respective units described above, well-known units in the image forming apparatus may be used. In addition, the image forming apparatus according to the exemplary embodiment may include other configurations and units in addition to the above-described matters. Further, in the image forming apparatus according to the exemplary embodiment, plural units of the above-described units may be concurrently used.

In addition, the image forming apparatus according to the exemplary embodiment preferably includes the cleaning unit for removing the electrostatic charge image developer remaining on the image holding member by using the cleaning blade.

5. Toner Cartridge, Developer Cartridge, and Process Cartridge

The toner cartridge according to the exemplary embodiment is a toner cartridge that contains at least the electrostatic charge image developing toner according to the exemplary embodiment.

The developer cartridge according to the exemplary embodiment is a developer cartridge that contains at least the electrostatic charge image developer according to the exemplary embodiment.

In addition, the process cartridge according to the exemplary embodiment is a process cartridge which includes at least one selected from the group consisting of a developing unit for developing the electrostatic charge image on the surface of the image holding member by using the electrostatic charge image toner or the electrostatic charge image developer so as to form a toner image, a charging unit for charging the image holding member and the surface of the image holding member, and a cleaning unit for removing the toner remaining on the surface of the image holding member, and the process cartridge preferably contains at least the electrostatic charge image developing toner according to the exemplary embodiment, or the electrostatic charge image developer according to the exemplary embodiment.

The toner cartridge according to the exemplary embodiment is preferably detachable from the image forming apparatus. That is, in the image forming apparatus having a configuration in which the toner cartridge is detachable from the image forming apparatus, the toner cartridge according to the exemplary embodiment which contains the toner according to the exemplary embodiment is preferably used.

The developer cartridge according to the exemplary embodiment is not particularly limited as long as it contains the electrostatic charge image developer containing the electrostatic charge image developing toner according to the exemplary embodiment. For example, the developer cartridge is detachable from the image forming apparatus including the developing unit, and contains the electrostatic charge image developer containing the electrostatic charge image developing toner according to the exemplary embodiment, as a developer to be supplied to the developing unit.

Further, the developer cartridge may be a cartridge that contains a toner and a carrier, and may be a cartridge in which a separated body of a cartridge that contains a toner alone and a cartridge that contains a carrier alone are separately formed.

The process cartridge according to the exemplary embodiment is preferably detachable from the image forming apparatus.

In addition, the process cartridge according to the exemplary embodiment may include other members such as an erasing unit if necessary.

The toner cartridge and the process cartridge may employ well-known configurations.

EXAMPLES

Hereinafter, the exemplary embodiments will be described with reference to Examples and Comparative examples, but are not limited to the Examples shown below. Further, in the Examples, unless otherwise specified, "part (s)" and "%" mean "part (s) by weight" and "% by weight", respectively.

Preparation of Polyester Resin (A1)

Polycarboxylic acid

Terephthalic acid: 90 mole equivalent 5-sulfoisophthalic acid monosodium: 10 mole equivalent Polyol Ethylene glycol: 45 mole equivalent 1,5-pentanediol: 46 mole equivalent Epoxy compound Polyepoxy compound (manufactured by DIC Corporation, Epiclon N-695: 9 mole equivalent 3 parts by weight in total of polycarboxylic acid component and polyol component are put into a flask equipped with a stirrer, a nitrogen introduction tube, a temperature sensor, and a rectifying column, a temperature is raised to 190° C. for one hour, and a catalyst Ti $(OBu)_4$ (0.003% by weight with respect to the total amount of titanium tetrabutoxide and polycarboxylic acid components) is poured into the mixture after confirming that the reaction system is stirred.

In addition, the temperature is slowly raised to 245° C. from 190° C. while removing generated water and a dehydration condensation reaction is continued for 6 hours to perform polymerization. After that, the temperature is lowered to 235° C., and a reaction is performed for 2 hours under the reduced pressure of 30 mmHg, thereby obtaining a polyester resin (A1).

The resin molecular weight of the obtained polyester resin (A1) is measured by using a gel permeation chromatography (GPC), and the weight average molecular weight is 80,000.

In addition, as a result of the measurement for heat properties of the obtained resin by using a differential scanning calorimeter, a glass transition temperature Tg is 61° C.

Further, a melting temperature (((½) drop temperature in a measurement with a flow tester, Tm) of the obtained resin is measured as a temperature corresponding to the midpoint (½) between the flow-starting temperature and the flow-completion temperature in the measurement in which a 1 $cm^3$ sample is melted and allowed to flow out in an elevated flow tester (trade name: CFT-500, manufactured by Shimadzu Corporation) with a dice pore diameter of 1 mm at a pressure of 10 $kg/cm^2$ and a temperature increase rate of 3° C./min., and as a result of the measurement, Tm is 145° C.

Preparation of Polyester Resin Coating Silica (1)

Polycarboxylic acid

Teraphthaiic acid: 90 main equivalent 5-sulfoisophthalic acid monosodium: 10 mole equivalent Polyol Ethylene glycol: 45 mole equivalent 1,5-pentanediol: 46 mole equivalent Epoxy compound Polyepoxy compound (manufactured by DIC Corporation, Epiclon H-695, a CRESOL NOVOLAK type epoxy resin, epoxy equivalent: 209 g/eq to 219 g/eq): 9 mole equivalent 3 parts by weight in the total of the polycarboxylic acid component and the polyol component are put into a flask equipped with a stirrer, a nitrogen introduction tube, a temperature sensor, and a rectifying column, a temperature is raised to 190° C. for one hour, and a catalyst Ti $(OBu)_4$ (0.003% by weight with respect to the total amount of polycarboxylic acid components) is poured into the mixture after confirming that the reaction system is stirred.

In addition, the temperature is slowly raised to 245° C. from 190° C. while removing generated water and a dehydration condensation reaction is continued for 3 hours, and then 5,000 parts by weight of silica having the average particle diameter of 40 nm which is prepared by using an aerosil method is put into 100 parts by weight of resin. The dehydration condensation reaction is continued for another 3 hours to perform polymerization. After that, the temperature is lowered to 235° C., and a reaction is performed for 2 hours under the reduced pressure of 30 mmHg, thereby obtaining a polyester resin coating silica (1).

Preparation of Dispersant (1) of Polymer Having Carboxyl Group styrene: 24.2 parts n-butyl acrylate: 18.2 parts Dimethyl aminoethyl acrylate: 52.8 parts Acrylic acid: 1.8 parts Dodecanethiol: 2.0 parts Divinyl adipate: 1.0 parts (The above materials are manufactured by Wako Pure Chemical Industries, Ltd.)

The above components are mixed and dissolved, and a mixture thereof is added to a solution obtained by dissolving 1.5 parts of nonionic surfactant (manufactured by Sanyo Chemical Industries, Ltd.: NONIPOL 400) and 2 parts of anionic surfactant, (manufactured by Dai-ichi Kogyo Seiyaku Co., Ltd.: Neogen S.C.) into 150 parts of ion exchange water, then is dispersed and emulsified in the flask, and 28.2 parts of ion exchange water in which 5 parts of sodium persulfate (manufactured by Wako Pure Chemical Industries, Ltd.) is dissolved is put into the flask while slowly nixing the resultant for 10 minutes. Then, nitrogen substitution is performed for 20 minutes at a late of 0.1 L/min. Thereafter, the contents of the flask are heated to 70° C. with an oil bath while stirring the contents in the flask, and then the emulsification and polymerization is continued for 5 hours, thereby preparing a dispersant (1) of the polymer having a carboxyl group, with the average particle diameter of 210 nm and concentration of solid content of 40%.

The obtained dispersant is kept on a 100° C. oven so as to remove the moisture thereof, and then the resultant is collected for measuring a polymer having a carboxyl group (1) by using differential scanning calorimetry (DSC). As a result, the glass transition temperature is 55° C., and the weight average molecular weight is 42,000. In this case, the weight ratio (MN/MS) of the amount of nitrogen atoms to the amount of sulfur atoms in the resin is 7.5.

Example 1

Preparation of Toner (1)

Preparation of Toner Particles (1)

Polyester resin (A1): 89 parts

Polyethylene wax (manufactured by TOYO ADL CORPORATION) PW725): 3 parts

Carbon black (manufactured by Cabot Corporation, Regal330): 7 parts

Charge control agent (manufactured by orient chemical industries co., ltd. BONTRON P-51): 1 part The above components are pre-mixed by using a HENSCHEL mixer, then are kneaded by using a twin-screw continuous kneader having a screw configuration under the kneading conditions such as a kneading rate of 15 kg/h and a kneading temperature of 120° C., and thereby a kneaded product is obtained. The obtained kneaded product is pulverized by using a pulverizer equipped with a crushing plate (IDS-2, manufactured by Nippon Pneumatic Mfg. Co., Ltd.), and then fine powders and coarse powders are removed by adjusting and changing a classifying edge with an ELBOW-JET AIR CLASSIFIER (manufactured by MATSUBO Corporation), thereby obtaining toner particles (1).

Preparation of Toner (1)

The obtained 100 parts of toner particles (1), 1 part of silica particles (manufactured by NIPPON AEROSIL CO., LTD., R972, the volume average particle diameter of 16 nm), 2 parts of polyester resin coating silica (1), and 0.5 parts of polymer having a carboxyl group (1) are mixed for 60 seconds at 6,000 rpm by using a sample mill, then are mixed for 15 minutes at the peripheral speed of 20 m/s by using a HENSCHEL mixer. Then, coarse particles may be removed by using a sieve with an aperture of 45 μm, thereby obtaining a toner (1).

Preparation of Carrier (1)

500 parts by weight of powders of spherical magnetite particles having the volume average particle diameter of 0.22 μm are put into a HENSCHEL mixer, are sufficiently stirred, then 4.5 parts by weight of titanate coupling agent is added thereto, and the resultant is mixed and stirred for 30 minutes while a temperature is raised to 95° C., thereby obtaining spherical magnetite particles which are coated with the titanate coupling agent.

Subsequently, 6.5 parts by weight of phenol, 10 parts by weight of 30% formalin, 500 parts by weight of the above magnetite particle, 7 parts by weight of 25% ammonia water, and 400 parts by weight of water are put into a four-necked flask, and are mixed and stirred. Next, a temperature is raised up to 85° C. for 60 minutes under the stirring, the reaction is performed for 180 minutes at the same temperature, then the flask is cooled to 25° C., 500 parts by weight of water is added to the flask, then a supernatant is removed, and a precipitate is washed with water. The resultant Is dried at 180° C. under the reduced pressure, and the coarse particles are removed by using a screen with an aperture of 106 μm, thereby obtaining core particles A having an average particle diameter of 32 μm. Next, 200 parts by weight of toluene, and 45 parts by weight of styrene methacrylate copolymer (component ratio of 20/80, weight overage molecular weight of 180,000) are stirred for 60 minutes by using a stirrer, thereby obtaining a coating resin solution.

1,000 parts by weight of core particles A and 40 parts by weight of coating resin solution are put into a vacuum degassing type kneader (rotor•clearance between wall surface: 25 mm), stirred for 30 minutes at 40 rpm while the temperature is kept at 60° C., then the temperature is raised to 85° C., and toluene is distilled, degassed, and dried under the reduced pressure. In addition, the resultant is sieved by a screen mesh with an aperture of 75 μm, thereby preparing a carrier (1). A shape factor SF2 of the carrier (1) is 106.

Preparation of Developer (1)

8 parts of obtained toner (1), and 100 parts of obtained carrier (1) are stirred for 20 minutes at 20 rpm by using a V-blender, and then sieved by a sieve mesh with an aperture of 212 μm, thereby obtaining a developer (1).

Example 2

Toner particles (2) are prepared by using the same method as in Example 1 except that the mole equivalent of 5-sulfoisophthalic acid monosodium is changed to be 12 mole equivalent. In addition, a developer (2) is prepared by using the same method as in Example 1 with the toner particles.

Example 3

Toner particles (3) are prepared by using the same method as in Example 1 except that the mole equivalent of 5-sulfoisophthalic acid monosodium is changed to be 8 mole equivalent. In addition, a developer (3) is prepared by using the same method as in Example 1 with the toner particles.

Example 4

Toner particles (4) are prepared by using the same method as in Example 1 except that the mole equivalent of terephthalic acid is changed to 88 mole equivalent, the mole equivalent of 5-sulfoisophthalic acid monosodium is changed to 11 mole equivalent, the mole equivalent of ethylene glycol is changed to 50 mole equivalent, and the mole equivalent of 1,5-pentanediol is changed to 40 mole equivalent. In addition, a developer (4) is prepared by using the same method as in Example 1 with the toner particles.

Example 5

Toner particles (5) are prepared by using the same method as in Example 1 except that the mole equivalent of terephthalic acid is changed to 95 mole equivalent, the mole equivalent of 5-sulfoisophthalic acid monosodium is changed to 6 mole equivalent, the mole equivalent of ethylene glycol is changed to 50 mole equivalent, and the mole equivalent of 1, 5-pentanediol is changed to 50 mole equivalent. In addition, a developer (5) is prepared by using the same method as in Example 1 with the toner particles.

Example 8

Toner particles (6) are prepared by using the same method as in Example 1 except that the mole equivalent of terephthalic acid is changed to 95 mole equivalent, and the mole equivalent of polyepoxy compound is changed to 12 mole equivalent. In addition, a developer (6) is prepared by using the same method as in Example 1 with the toner particles (6).

Example 7

Toner particles (7) are prepared by using the same method as in Example 1 except that the mole equivalent of the terephthalic acid is changed to 85 mole equivalent, and the mole equivalent of polyepoxy compound is changed to 7 mole equivalent. In addition, a developer (7) is prepared by using the same method as in Example 1 with the toner particles.

Example 8

Toner particles (8) are prepared by using the same method as in Example 1 except that conditions of a pulverizer equipped with a crushing plate (IDS-2, manufactured by Nippon Pneumatic Mfg. Co., Ltd.) and an Elbow-Jet air classifier (manufactured by MATSUBO Corporation) are changed. In addition, a developer (8) is prepared by using the same method as in Example 1 with the toner particles.

Example 9

Toner particles (9) are prepared by using the same method as in Example 1 except that conditions of a pulverizer equipped with a crushing plate (IDS-2, manufactured by Nippon Pneumatic Mfg. Co., Ltd.) and on Elbow-Jet air classifier (manufactured by MATSUBO Corporation) are changed. In addition, a developer (9) is prepared by using the same method as in Example 1 with the toner particles.

Example 10

Toner particles (10) are prepared by using the same method as in Example 1 except that in the toner external addition step, a condition of the polyester resin coating silica (1) is changed that the weight thereof is set to be 8 parts. In addition, a developer (10) is prepared by using the same method as in Example 1 with the toner particles.

Example 11

Toner particles (11) are prepared by using the same method as in Example 1 except that in the toner external addition step, a condition of the polyester resin coating silica (1) is changed that the weight thereof is set to be 1.2 parts. In addition, a developer (11) is prepared by using the same method as in Example 1 with the toner particles.

Example 12

Toner particles (12) are prepared by using the same method as in Example 1 except that in the toner external addition step, the polyester resin coating silica (1) is not added. In addition, a developer (12) is prepared by using the same method as in Example 1 with the toner particles.

Example 13

Toner particles (13) are prepared by using the same method as in Example 1 except that in the toner external addition step, a condition of the polymer having a carboxyl group (1) is changed that the weight thereof is set to be 1.9 pacts. In addition, a developer (13) is prepared by using the same method as in Example 1 with the toner particles.

Example 14

Toner particles (14) are prepared by using the same method as in Example 1 except that in the toner external addition step, a condition of the polymer having a carboxyl group (1) is changed that the weight thereof is set to be 0.2 parts. In addition, a developer (14) is prepared by using the same method as in Example 1 with the toner particles.

Example 15

Toner particles (15) are prepared by using the same method as in Example 1 except that in the toner external addition step, the polymer having a carboxyl group (1) is not added. In addition, a developer (15) is prepared by using the same method as in Example 1 with the toner particles.

Comparative Example 1

Toner particles (16) are prepared by using the same method as in Example 1 except that the mole equivalent of terephthalic acid is changed to 100 mole equivalent, the mole equivalent of 5-sulfoisophthalic acid monosodium is changed to 20 mole equivalent, the mole equivalent of ethylene glycol is changed to 55 mole equivalent, the mole equivalent of 1,5-pentanediol is changed to 50 mole equivalent, and the mole equivalent of polyepoxy compound is changed to 8 mole equivalent. In addition, a developer (16) is prepared by using the same method as in Example 1 with the toner particles.

Comparative Example 2

Toner particles (17) are prepared by using the same method as in Example 1 except that the mole equivalent of terephthalic acid is changed to 82 mole equivalent, the mole equivalent of 5-sulfoiaophthalic acid monosodium is changed to 8 mole equivalent, the mole equivalent of ethylene glycol is changed to 40 mole equivalent, the mole equivalent of 1, 5-pentanediol is changed to 40 mole equivalent, and the mole equivalent of polyepoxy compound is changed to 4 mole equivalent. In addition, a developer (17) is prepared by using the same method as in Example 1 with the toner particles.

Comparative Example 3

Toner particles (18) are prepared by using the same method as in Example 1 except that the mole equivalent of terephthalic acid is changed to 100 mole equivalent, the mole equivalent of 5-sulfoisophthalic acid monosodium is changed to 12 mole equivalent, the mole equivalent of ethylene glycol is changed to 42 mole equivalent, the mole equivalent of 1, 5-pentanediol is changed to 45 mole equivalent, and the mole equivalent of polyepoxy compound is changed to 6 mole equivalent. In addition, a developer (18) is prepared by using the same method as in Example 1 with the toner particles.

Comparative Example 4

Toner particles (19) are prepared by using the same method as in Example 1 except that the mole equivalent of terephthalic acid is changed to 80 mole equivalent, the mole equivalent of 5-sulfoisophthalic acid monosodium is changed to 8 mole equivalent, the mole equivalent of ethylene glycol is changed to 41 mole equivalent, the mole equivalent of 1,5-pentanediol is changed to 45 mole equivalent, and the mole equivalent of polyepoxy compound is changed to 2 mole equivalent. In addition, a developer (19) is prepared by using the same method as in Example 1 with the toner particles.

Comparative Example 5

Toner particles (20) are prepared by using the same method as in Example 1 except that the mole equivalent of the polyepoxy compound is changed to 20 mole equivalent. In addition, a developer (20) is prepared by using the some method as in Example 1 with the toner particles.

Comparative Example 6

Toner particles (21) are prepared by using the same method as in Example 1 except that the mole equivalent of the polyepoxy compound is changed to 0.5 mole equivalent. In addition, a developer (21) is prepared by using the same method as in Example 1 with the toner particles.

Evaluation Method

Evaluation of Low Temperature Offset

The respective developers are put into a developing device of an image forming apparatus "DOCUCENTRE COLOR 500" modified machine (manufactured by Fuji Xerox Co., Ltd., under the conditions of fixing temperature of 120° C., image forming tote of 350 mm/sec) which employs a two-component contact developing system, kept for 2 hours under the environment of temperature of 50° C. and relative humidity of 100% RH, and then 20 sheets of paper of images which have 100% of image density and a width of 20 mm in the transfer direction of a recording sheet (manufactured by Xerox Corporation, Colotech+90 gsm), thereby performing evaluation thereof based on the following criteria.

A: No problem at all

B: Image defects cannot be visually confirmed, but may be slightly confirmed when expanding images C: Image defects are visually confirmed, which is level of causing no problem D: it is determined to be NG (practically unsuitable) due to mage defects Evaluation of High Temperature Offset The respective developers are put into a developing device of an image forming apparatus "DOCUCENTRE COLOR 500" modified machine (manufactured by Fuji Xerox Co., Ltd., under the conditions of fixing temperature of 220° C., image forming rate of 250 mm/sec) which employs a two-component contact developing system, kept for 2 hours under the environment of temperature of 50° C. and relative humidity of 100% RH, and then images which have 100% of image density and a width of 20 mm are output on 20 sheets of paper in the transfer direction of a recording sheet (manufactured by Xerox Corporation, Colotech+90 gsm), thereby performing evaluation thereof based on the following criteria.

A: No problem at all

B: Image defects cannot be visually confirmed, but may be slightly confirmed when expanding images C: Image defects are visually confirmed, which is level of causing no problem D: It is determined to be NG (practically unsuitable) due to mage defects Evaluation of Image Density and Image Fogging The respective developers are put into a developing device of an image forming apparatus "DOCUCENTRE COLOR 500" modified machine (manufactured by Fuji Xerox Co., Ltd., under the conditions of fixing temperature of 220° C., image forming rate of 250 mm/sec) which employs a two-component contact developing system, kept for 2 hours under the environment of temperature of 50° C. and relative humidity of 100% RH, and then images (a patterned chart image having black solid images in a square 3 cm×3 cm on the upper left, center, and lower right sides) which have 15% of image density (AC) are output on 500 sheets of paper (manufactured by Xerox Corporation, Premier 80, A4 size) in the transfer direction of a recording sheet (manufactured by Xerox Corporation. Colotech+90 gsm). Then, the image fogging and the image density are evaluated based on the following evaluation method.

Regarding five black solid images such as one in the center of the sheet, two at a position distant from the top by 50 mm and from the left and right side by 50 mm, and two at a position distant from the bottom by 50 mm and from the left and right side by 50 mm, a measurement is performed by using an image densitometer (X-RITE 938: manufactured by X-Rite, Inc.,) so as to obtain an average density E. The results thereof will be evaluated based on the following criteria.

Evaluation Criteria of Image Density

A: E is equal to or greater than 1.4

B: E is equal to or greater than 1.2 and less than 1.4

C: E is equal to or greater than 1.0 and less than 1.2

D: E is loss than 1.0

Printing of white sheets is followed by the printing of the black solid Images, and regarding five images such as one in the center of the sheet, two at a position distant from the top by 50 mm and from the left and right side by 50 mm, and two at a position distant from the bottom by 50 mm and from the left and right side by 50 mm, a measurement is performed by using an image densitometer (X-RITE 933: manufactured by x-Rite, Inc.,) so as to measure ΔE of the printed sheets and non-printed sheets. The results thereof will be evaluated based on the following criteria.

Evaluation Criteria of Background Image Fogging

A: ΔE is loss than 0.3

B: ΔE is equal to or greater than 0.3 and less than 0.5

C: ΔE is equal to or greater than 0.5 and less than 1.0

D: ΔE is equal to or greater than 1.0

Evaluation of Background Image Fogging After Re-Drying

A toner cartridge for a "DOCUCENTRE COLOR 500" modified machine is filled with the toners prepared in the respective examples, is kept for 2 hours under the environment of temperature of 50° C. and relative humidity of 100% RH, subsequently is kept for 2 hours under the environment of temperature of 50° C. and relative humidity of 20% RH, and then the toner cartridge is loaded in the "DOCUCENTRE COLOR 500" modified machine. After that, images (a patterned chart image having black solid images in a square 3 cm×3 cm on the left, center, and lower right sides) which have 15% of image density (AC) are output on 500 sheets of paper (manufactured by Xerox Corporation, Premier 80, A4 size) in the transfer direction of a recording sheet (manufactured by Xerox Corporation, Colotech+90 gsm). Then, the image fogging is evaluated based on the following evaluation method.

Evaluation Criteria of Background Image Fogging After Re-Drying

A: ΔE is less than 0.3

B: ΔE is equal to or greater than 0.3 and less than 0.5

C: ΔE is equal to or greater than 0.5 and less than 1.0

D: ΔE is equal to or greater than 1.0

The evaluation results are indicated in Table 1.

TABLE 1

| | Toner properties | | | Toner particles | | | Evaluation | | | | |
|---|---|---|---|---|---|---|---|---|---|---|---|
| | Melt viscosity A at the time of absorbing moisture [$\times 10^3$ Pa · s] | Melt viscosity B at the time of drying [$\times 10^4$ Pa · s] | Tg [° C.] | Volume average particle diameter [μm] | Additive amount of polyester resin coating silica [% by weight] | Additive amount of polymer having carboxyl group [% by weight] | Anti-offset properties at low temperature | Anti-offset properties at high temperature | Image density | Image fogging | Image fogging after re-drying |
| Example 1 | 4.0 | 2.0 | 58 | 7.0 | 2.0 | 0.50 | A | A | A | A | A |
| Example 2 | 5.8 | 2.3 | 59 | 7.0 | 2.0 | 0.50 | B | A | A | A | A |
| Example 3 | 3.1 | 1.8 | 58 | 7.0 | 2.0 | 0.50 | A | A | A | B | A |
| Example 4 | 4.0 | 3.8 | 57 | 7.0 | 2.0 | 0.50 | B | A | A | A | A |
| Example 5 | 4.1 | 1.3 | 58 | 7.0 | 2.0 | 0.50 | A | A | A | A | B |
| Example 6 | 4.0 | 2.0 | 68 | 7.0 | 2.0 | 0.50 | B | A | A | A | A |
| Example 7 | 4.2 | 2.1 | 51 | 7.0 | 2.0 | 0.50 | A | B | A | A | A |
| Example 8 | 4.0 | 2.0 | 58 | 13 | 2.0 | 0.50 | A | A | A | C | B |
| Example 9 | 4.0 | 2.0 | 58 | 5.2 | 2.0 | 0.50 | A | A | C | A | A |
| Example 10 | 4.0 | 2.0 | 58 | 7.0 | 8.0 | 0.50 | A | A | A | C | C |
| Example 11 | 4.0 | 2.0 | 58 | 7.0 | 1.2 | 0.50 | B | A | A | A | A |
| Example 12 | 4.0 | 2.0 | 58 | 7.0 | 0 | 0.50 | C | A | A | A | A |
| Example 13 | 4.0 | 2.0 | 58 | 7.0 | 2.0 | 1.9 | A | A | A | C | C |
| Example 14 | 4.0 | 2.0 | 58 | 7.0 | 2.0 | 0.20 | B | A | A | A | A |
| Example 15 | 4.0 | 2.0 | 58 | 7.0 | 2.0 | 0 | C | A | A | A | A |
| Comparative Example 1 | 7.2 | 3.8 | 61 | 7.0 | 2.0 | 0.20 | D | A | A | B | A |
| Comparative Example 2 | 1.1 | 1.2 | 57 | 7.0 | 2.0 | 0.20 | A | C | A | D | A |
| Comparative Example 3 | 5.4 | 4.9 | 59 | 7.0 | 2.0 | 0.20 | D | A | B | B | B |
| Comparative Example 4 | 2.3 | 0.84 | 57 | 7.0 | 2.0 | 0.20 | B | B | B | B | D |
| Comparative Example 5 | 4.3 | 2.1 | 73 | 7.0 | 2.0 | 0.20 | A | D | B | A | A |
| Comparative Example 6 | 2.9 | 2.3 | 48 | 7.0 | 2.0 | 0.20 | D | A | B | D | D |

Note that, a melt viscosity A at the time of moisture absorption in Table 1 is the melt viscosity of toner A at 110° C. after storage for 2 hours under the environment of absolute humidity of 82.7 (g/m$^3$), and a melt viscosity B at the time of drying is the melt viscosity of toner B at 110° C. after storage for 2 hours under the environment of absolute humidity of 16.5 (g/m$^3$). In addition, the additive amount of the polyester resin coating silica, and the additive amount of the polymer having a carboxyl group are obtained with respect to the entire weight of the toner particles.

The foregoing description according to the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on a charged surface of the image holding member;

a developing unit that contains an electrostatic charge image developer and develops the electrostatic charge image formed on the surface of the image holding member as a toner image by using the electrostatic charge image developer;

a transfer unit that transfers the toner image formed on the surface of the image holding member onto a surface of a recording medium;

a cleaning unit that includes a cleaning blade for cleaning the surface of the image holding member; and a fixing unit that fixes the toner image transferred onto the recording medium, wherein the electrostatic charge image developer contains a carrier and an electrostatic charge image developing toner, the electrostatic charge image developing toner includes toner particles which contain a polyester resin which is a polycondensate of a polycarboxylic acid and a polyol, and the toner has a glass transition temperature of 50° C. to 70° C., the polyol includes a polyol not having a bisphenol A structure in a range of 50% by weight to 100% by weight with respect to the entire weight of the polyol, a melt viscosity A of the toner at 110° C. after storage for 2 hours under the environment of absolute humidity of 82.7 (g/m$^3$) is from $2.0\times10^3$ (Pa·s) to $6.0\times10^3$ (Pa·s), a melt viscosity B of the toner at 110° C. after storage for 2 hours under the environment of absolute humidity of 16.5 (g/m$^3$) is from $1.0\times10^4$ (Pa·s) to $4.0\times10^4$ (Pa·s), and the electrostatic charge image developing toner includes inorganic particles having a polyester resin on the surface thereof, which are externally added to the toner particles, in a range of 1% by weight to 10% by weight with respect to the entire weight of the toner.

2. The image forming apparatus according to claim 1, wherein a volume average particle diameter of the electrostatic charge image developing toner is from 5 μm to 14 μm.

3. An electrostatic charge image developer which is used for an image forming apparatus, comprising:

a carrier; and an electrostatic charge image developing toner that includes toner particles which contain a polyester resin which is a polycondensate of a polycarboxylic acid and a polyol, and that has a glass transition temperature of 50° C. to 70° C., wherein the polyol includes a polyol not having a bisphenol A structure in a range of 50% by weight to 100% by weight with respect to the entire weight of the polyol, a melt viscosity A of the toner at 110° C. after storage for 2 hours under the environment of absolute humidity of 82.7 (g/m$^3$) is from $2.0\times10^3$ (Pa·s) to $6.0\times10^3$ (Pa·s), a melt viscosity B of the toner at 110° C. after storage for 2 hours under the environment of absolute humidity of 16.5 (g/m$^3$) is from $1.0\times10^4$ (Pa·s) to $4.0\times10^4$ (Pa·s), and the electrostatic charge image developing toner includes inorganic particles having a polyester resin on the surface thereof, which are externally added to the toner particles, in a range of 1% by weight to 10% by weight with respect to the entire weight of the toner.

4. An electrostatic charge image developing toner which is used for an image forming apparatus, comprising:

toner particles which contain a polyester resin which is a polycondensate of a polycarboxylic acid and a polyol, wherein the polyol includes a polyol not having a bisphenol A structure is from 50% by weight to 100% by weight with respect to the entire weight of the polyol, the toner has a glass transition temperature of 50° C. to 70° C., a melt viscosity A of the toner at 110° C. after storage for 2 hours under the environment of absolute humidity of 82.7 (g/m$^3$) is from $2.0\times10^3$ (Pa·s) to $6.0\times10^3$ (Pa·s), a melt viscosity B of the toner at 110° C. after storage for 2 hours under the environment of absolute humidity of 16.5 (g/m$^3$) is from $1.0\times10^4$ (Pa·s) to $4.0\times10^4$ (Pa·s), and the electrostatic charge image developing toner includes inorganic particles having a polyester resin on the surface thereof, which are externally added to the toner particles, in a range of 1% by weight to 10% by weight with respect to the entire weight of the toner.

5. The image forming apparatus according to claim 1, wherein the electrostatic charge image developing toner includes a polymer having a carboxyl group, which is externally added to the toner particles, in a range of 0.1% by weight to 2% by weight with respect to the entire weight of the toner.

* * * * *